US009904208B2

(12) United States Patent
Maeda et al.

(10) Patent No.: US 9,904,208 B2
(45) Date of Patent: Feb. 27, 2018

(54) ACCOMMODATING CONTAINER, CLEANING DEVICE, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Naoki Maeda, Suntou-gun (JP); Noriyuki Komatsu, Numazu (JP); Naoki Matsumaru, Suntou-gun (JP); Ryuta Murakami, Suntou-gun (JP); Takatoshi Hamada, Mishima (JP); Hiroaki Nosho, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/288,038

(22) Filed: Oct. 7, 2016

(65) Prior Publication Data

US 2017/0108798 A1 Apr. 20, 2017

(30) Foreign Application Priority Data

Oct. 14, 2015 (JP) ..... 2015-202501

(51) Int. Cl.
*G03G 15/08* (2006.01)
*G03G 15/095* (2006.01)

(52) U.S. Cl.
CPC ..... *G03G 15/0865* (2013.01); *G03G 15/0891* (2013.01); *G03G 15/095* (2013.01)

(58) Field of Classification Search
CPC combination set(s) only.
See application file for complete search history.

(56) References Cited

U.S. PATENT DOCUMENTS

2005/0019070 A1* 1/2005 Suda ..... G03G 15/01 399/346
2006/0083554 A1 4/2006 Nishihama et al.
2006/0165440 A1 7/2006 Adachi

FOREIGN PATENT DOCUMENTS

EP 0 833 225 A1 4/1998
EP 1 826 631 A1 8/2007
JP 2009-210684 A * 9/2009 ..... G03G 15/08

(Continued)

OTHER PUBLICATIONS

European Search Report dated Mar. 17, 2017, in related European Patent Application No. 16193452.6.

(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An accommodating device for collecting developer from an image bearing member includes an accommodating container for accommodating the developer from the image bearing member, a feeding member for feeding the developer in a developer feeding direction and provided in the accommodating container, and a wall member for partitioning inside of the accommodating container. The wall member is provided in the accommodating container and extends along a direction crossing the developer feeding direction and inclined toward a downstream side of the feeding member with respect to the developer feeding direction. The wall member is contactable to the developer being fed in the developer feeding direction.

20 Claims, 9 Drawing Sheets

(56) References Cited

FOREIGN PATENT DOCUMENTS

| | | | |
|---|---|---|---|
| JP | 2009-210684 | A | 9/2009 |
| JP | 2011-242524 | A | 12/2011 |

OTHER PUBLICATIONS

Ryuta Murakami et al., U.S. Appl. No. 15/288,096, filed Oct. 7, 2016.
Hiroaki Nosho et al., U.S. Appl. No. 15/288,024, filed Oct. 7, 2016.

* cited by examiner (a)

(b)

(a)

(b)

(a)

(b)

ACCOMMODATING CONTAINER, CLEANING DEVICE, DEVELOPING DEVICE, PROCESS CARTRIDGE, AND IMAGE FORMING APPARATUS

FIELD OF THE INVENTION AND RELATED ART

The present invention relates to an accommodating container, a cleaning device, a developing device, a process cartridge, and an image forming apparatus.

Here, the accommodating container is a container for accommodating a developer for use with the image forming apparatus.

Further, the process cartridge is such a cartridge that an image bearing member such as an electrophotographic photosensitive drum is at least provided and that the image bearing member and a process means actable on the image bearing member are integrally provided. Such a process cartridge is detachably mounted in a main assembly of the image forming apparatus. For example, it is possible to cite a process cartridge prepared by integrally assembling the electrophotographic photosensitive drum and, as the process means, at least one of a developing means, a charging means and a cleaning means into a cartridge.

Further, an electrophotographic image forming apparatus forms an image on a recording material (medium) using an electrophotographic image forming method. Examples of the electrophotographic image forming apparatus may include an electrophotographic copying machine, an electrophotographic printer (LED printer, laser beam printer or the like), a facsimile machine, a word processor, and so on.

In the electrophotographic image forming apparatus, in general, a drum-shaped electrophotographic photosensitive member, i.e., a photosensitive drum as an image bearing member is electrically charged uniformly. Then, the charged photosensitive drum is selectively exposed to light, so that an electrostatic latent image is formed on the photosensitive drum. Then, the electrostatic latent image formed on the photosensitive drum is developed as a toner image with a toner as a developer. Then, the toner image formed on the photosensitive drum is transferred onto the recording material such as a recording sheet or a plastic sheet, and then the toner image transferred on the recording material is subjected to application of heat and pressure and thus is fixed on the recording material to effect image recording.

Such an image forming apparatus requires toner supply and maintenance of various process means in general. In order to facilitate the toner supply and the maintenance, a process cartridge in which the photosensitive drum, the charging means, the developing means, the cleaning means and the like are integrally assembled into a cartridge in a single frame is made detachably mountable to an image forming apparatus main assembly and has been put into practical use.

According to this process cartridge type, the maintenance of the devices can be made by a user himself (herself), and therefore operativity can be remarkably improved, so that it is possible to provide an image forming apparatus excellent in usability. For that reason, the process cartridge type has been widely used in the image forming apparatus.

The process cartridge described above includes a toner accommodating chamber for accommodating a residual toner generating by scraping off the toner, which has not been fixed on the recording material, with a cleaning means. As a method of accommodating the toner in the toner accommodating chamber, a constitution using a screw and a partition wall has been known (Japanese Laid-Open Patent Application (JP-A) 2011-242524).

However, in recent years, an increase in capacity and lifetime extension of the process cartridge has been required. Particularly, as in the constitution disclosed in JP-A 2011-242524, in a type in which the toner accommodating chamber is partitioned by the partition wall perpendicular to the screw for feeding the toner with respect to a toner feeding direction, the toner cannot be accommodated in an entirety of a broad toner accommodating chamber. Further, when the toner in a large amount is accommodated in the toner accommodating chamber, there is a possibility that the toner stagnates at an intermediary position and breaks the screw due to its load.

SUMMARY OF THE INVENTION

A principal object of the present invention is to provide an accommodating container, a cleaning device, a developing device, a process cartridge, and an image forming apparatus in which a developer can be accommodated in an entirety of an accommodating portion without exerting an excessive load on a feeding member for feeding the developer.

According to an aspect of the present invention, there is provided an accommodating container for accommodating a developer, comprising: a feeding member for feeding the developer in the accommodating container; and a wall member provided in the accommodating container and extending along a direction crossing a developer feeding direction of the feeding member and inclined so that a distance from the feeding member increases toward a downstream side of the feeding member with respect to the developer feeding direction.

Further features of the present invention will become apparent from the following description of exemplary embodiments with reference to the attached drawings.

DESCRIPTION OF THE EMBODIMENTS

Embodiments of the present invention will be described in detail with reference to the drawings. In the following description, a rotational axis direction of a photosensitive drum is a longitudinal direction. Further, with respect to the longitudinal direction, a side in which the photosensitive drum receives a driving force from an apparatus main assembly of an image forming apparatus is a driving side, and an opposite side thereof is a non-driving side.

<First Embodiment>

(General Structure of Image Forming Apparatus)

Figure 2:
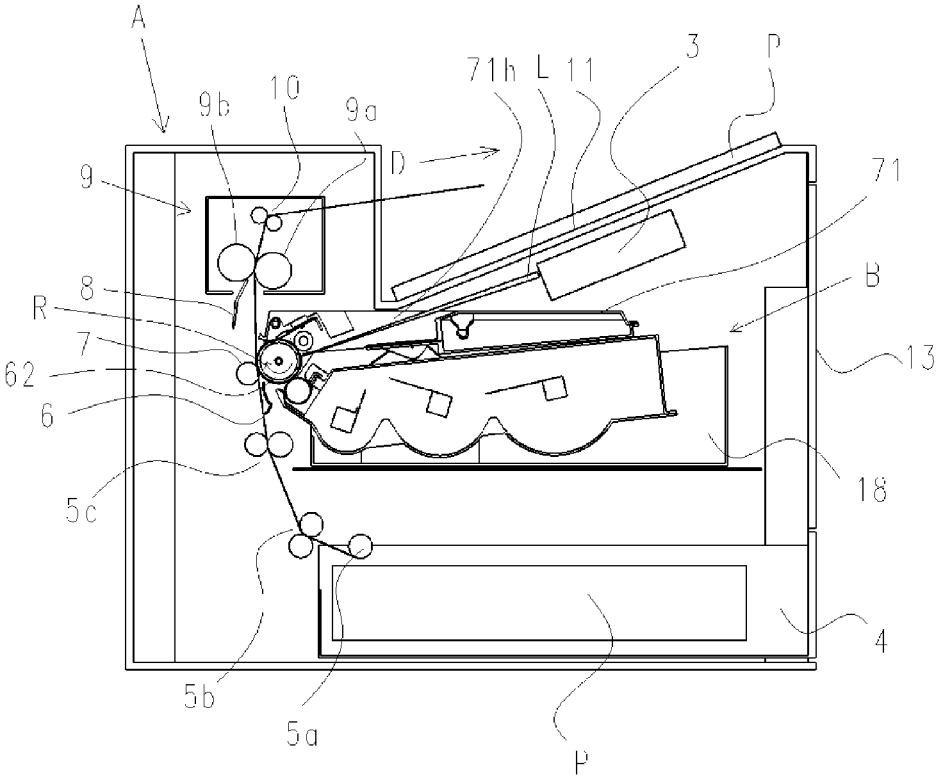
FIG. 2 is a sectional view showing a main assembly of an image forming apparatus in which the accommodating container in the First Embodiment is mounted and showing a process cartridge.

FIG. 2 is a sectional view showing a main assembly of an image forming apparatus 1 (hereinafter referred to as an apparatus main assembly A) in which an accommodating container according to this embodiment is mounted and showing a process cartridge (hereinafter referred to as a cartridge B. The apparatus main assembly A is a portion from which the cartridge B is removed.

The image forming apparatus shown in FIG. 2 is a laser beam printer using electrophotography in which the cartridge B is detachably mountable to the apparatus main assembly A. When the cartridge B is mounted in the apparatus main assembly A, an exposure device (laser scanner unit) 3 for forming an electrostatic latent image on an electrophotographic photosensitive drum (hereinafter referred to as a drum) 62 of the cartridge B is provided. Further, below the cartridge B, a sheet (feeding) tray 4 in which a recording material or medium (hereinafter referred to as a sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

(Image Forming Process)

Figure 3:
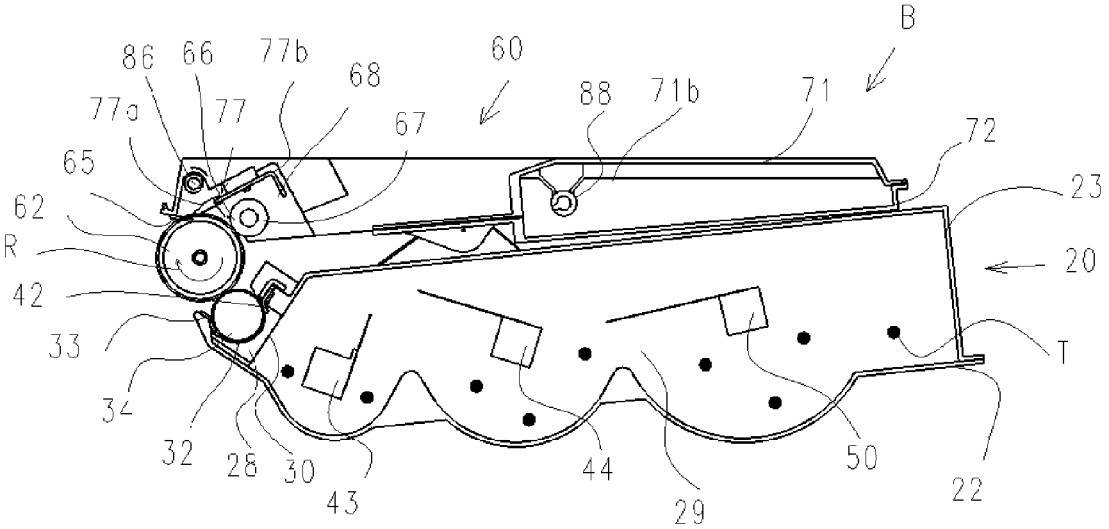
FIG. 3 is a sectional view of the process cartridge in which the accommodating container in the First Embodiment is mounted.

An outline of an image forming process will be described using FIGS. 2 and 3. FIG. 3 is a sectional view of the cartridge B.

As shown in FIG. 2, on the basis of a print start signal, the drum 62 is rotationally driven an a predetermined peripheral speed (process speed) in an arrow R direction. Then, as shown in FIG. 3, a charging roller 66 to which a bias voltage is applied contacts the outer peripheral surface of the drum 62 and electrically charges the outer peripheral surface of the drum 62 uniformly.

The exposure device 3 outputs laser light L depending on image information as shown in FIG. 2. The laser light L passes through a laser opening 71*h* provided in a cleaning frame 71, so that the outer peripheral surface of the drum 62 is subjected to scanning exposure. As a result, on the outer peripheral surface of the drum 62, the electrostatic latent image depending on the image information is formed.

On the other hand, as shown in FIG. 3, a toner T in a toner chamber 29 provided in a developing unit 20 as a developing device is stirred and fed by rotation of a first stirring member 43, a second stirring member 44 and a third stirring member 50, thus being sent to a toner supplying chamber 28. The toner T is carried by a magnetic force of a magnet roller 34 (fixed magnet) on a surface of a developing roller 32. The toner T is regulated in layer thickness on the peripheral surface of the developing roller 32 by a developing blade 42 as a collecting member for collecting the developer while being triboelectrically charged. Thereafter, the toner T is supplied onto the drum 62 depending on the electrostatic latent image, so that the electrostatic latent image is visualized (developed) as a toner image.

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11 in an arrow D direction.

On the other hand, as shown in FIG. 3, from the drum 62 after the transfer, a residual toner remaining on the outer peripheral surface of the drum 62 is removed by a cleaning blade 77, and the drum 62 is used again in the image forming process. The residual toner removed from the drum 62 is stored in a residual toner chamber 71*b* of a cleaning unit 60.

(Mounting and Demounting of Cartridge Relative to Apparatus Main Assembly)

Figure 5:
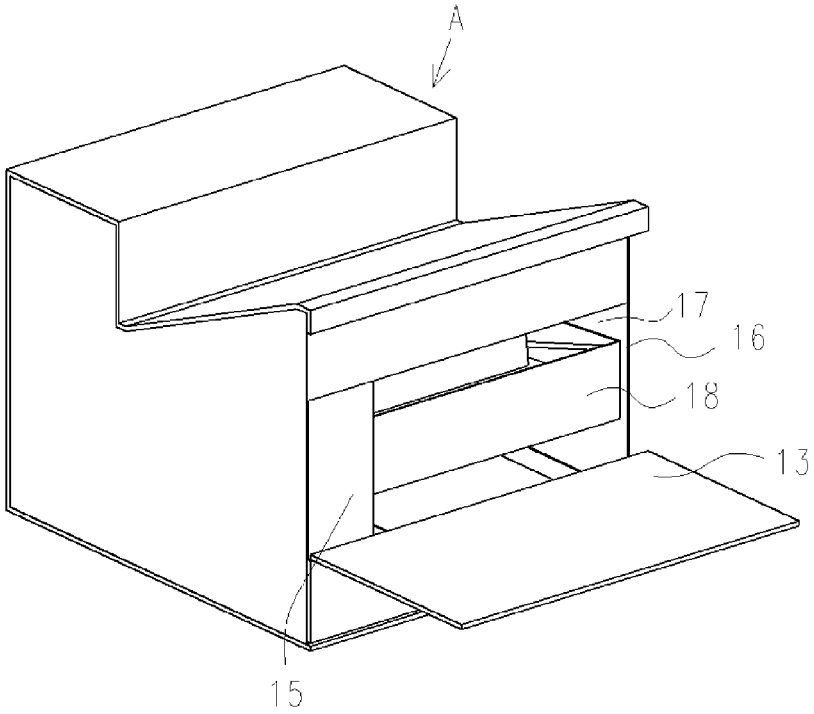
FIG. 5 is a perspective view of the image forming apparatus main assembly in a state in which an openable door of the image forming apparatus in which the accommodating container in the First Embodiment is mounted is open.
Figure 6:
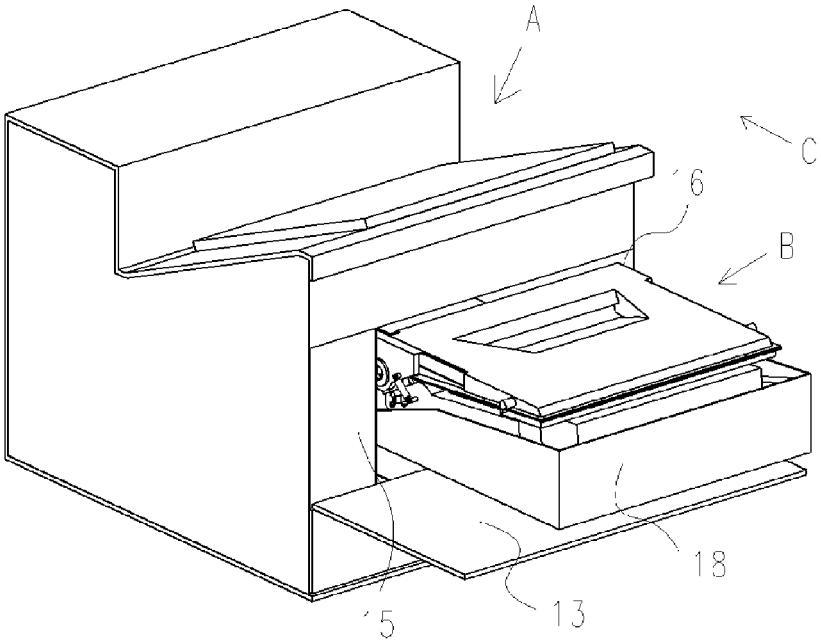
FIG. 6 is a perspective view of the image forming apparatus main assembly in a state in which the openable door of the image forming apparatus in which the accommodating container in the First Embodiment is mounted is opened and then a tray is pulled out.
Figure 7:
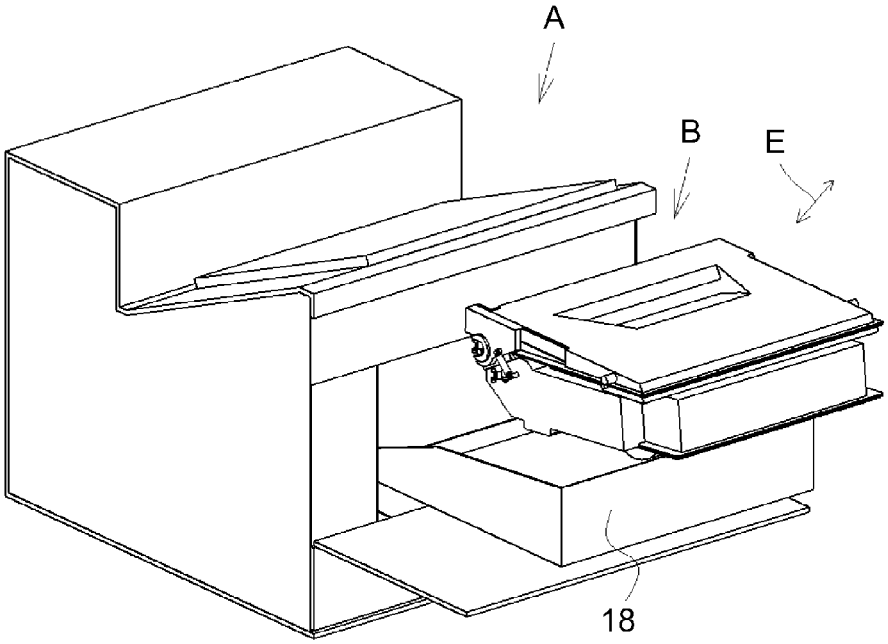
FIG. 7 is a perspective view of the image forming apparatus main assembly and the process cartridge when the process cartridge is mounted in and demounted from the tray in the state in which the openable door of the image forming apparatus in which the accommodating container in the First Embodiment is mounted is opened and then the tray is pulled out.
Figure 8:
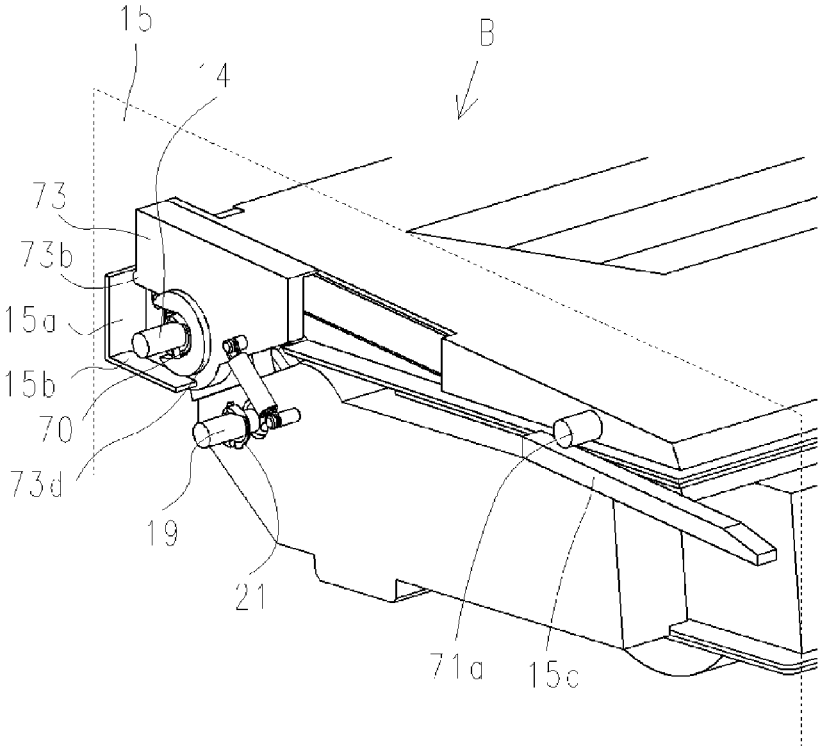
FIG. 8 is a perspective view showing a driving side positioning portion between the process cartridge and the image forming apparatus main assembly in a state in which the process cartridge is mounted in the image forming apparatus main assembly in the image forming apparatus in which the accommodating container in the First Embodiment is mounted.

Next, mounting and demounting of the cartridge B will be described using FIGS. 5 to 8. FIG. 5 is a perspective view of the apparatus main assembly A of which an openable door 13 is opened for permitting mounting and demounting of the cartridge B. FIG. 6 is a perspective view of the apparatus main assembly A and the cartridge B in a state in which the openable door 13 is opened for permitting the mounting and demounting of the cartridge B and then a tray 18 is pulled out. FIG. 7 is a perspective view of the apparatus main assembly A and the cartridge B when the cartridge B is demounted and mounted in a state in which the openable door 13 is opened and then the tray 18 is pulled out. FIG. 8 is a perspective view of a driving side positioning portion between the cartridge B and the apparatus main assembly A in a state in which the cartridge B is mounted in the apparatus main assembly A.

As shown in FIG. 5, to the apparatus main assembly A, the openable door 13 is rotatably attached, and when the openable door 13 is opened, a cartridge inserting opening 17 is exposed. In the cartridge inserting opening 17, a tray 18 for mounting the cartridge B in the apparatus main assembly A is provided. As shown in FIG. 6, when the tray 18 is pulled out to a predetermined position, the cartridge B can be mounted and demounted. The cartridge B is inserted (mounted) in the apparatus main assembly A along a guide rail (not shown) in an arrow C direction in FIG. 6 in a state in which the cartridge B is placed on the tray 18. The mounting and demounting of the cartridge B relative to the tray 18 are made along an arrow E direction in FIG. 7.

The apparatus main assembly A is provided with a first driving shaft 14 and a second driving shaft 19 as shown in FIG. 8. The first driving shaft 14 transmits a driving force to a first coupling 70 of the cartridge B. The second driving shaft 19 transmits a driving force to a second coupling 21. The first driving shaft 14 and the second driving shaft 19 are driven by a motor (not shown) of the apparatus main assembly A. As a result, the drum 62 connecting with the first coupling 70 receives the driving force from the apparatus main assembly A and is rotated.

The developing roller 32 is rotated by transmission of the driving force from the second coupling 21. Further, to the charging roller 66 and the developing roller 32, a predetermined bias voltage is applied by an electric power supplying portion (not shown) of the apparatus main assembly A.

(Cartridge Supporting Structure of Apparatus Main Assembly)

Figure 9:
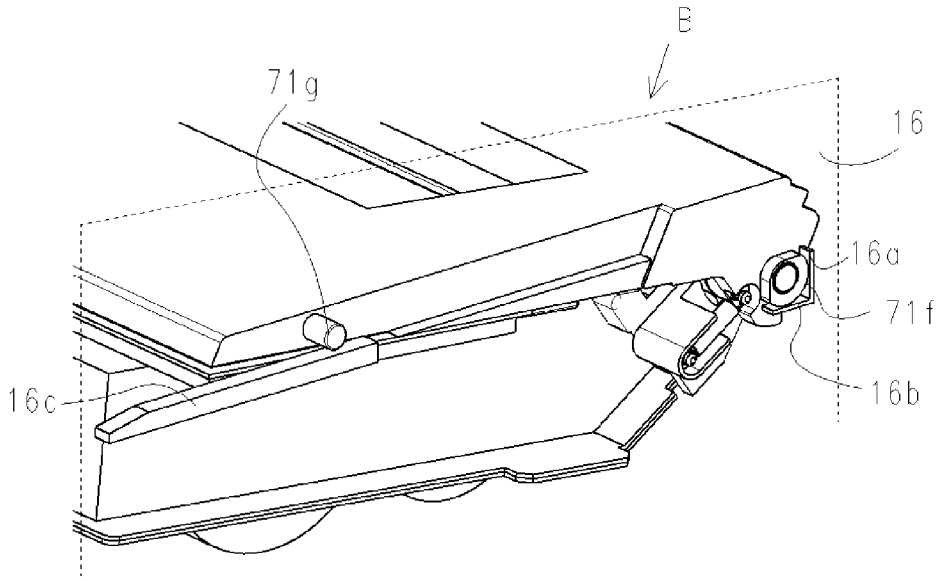
FIG. 9 is a perspective view showing a non-driving side positioning portion between the process cartridge and the image forming apparatus main assembly in the state in which the process cartridge is mounted in the image forming apparatus main assembly in the image forming apparatus in which the accommodating container in the First Embodiment is mounted.

Next, a supporting structure of the cartridge B by the apparatus main assembly A will be described using FIGS. 5, 8 and 9. FIG. 5 is a perspective view of the apparatus main assembly A of which an openable door 13 is opened for permitting mounting and demounting of the cartridge B. FIG. 8 is a perspective view of a driving side positioning portion between the cartridge B and the apparatus main assembly A in a state in which the cartridge B is mounted in the apparatus main assembly A. FIG. 9 is a perspective view of a non-driving side positioning portion between the cartridge B and the apparatus main assembly A in a state in which the cartridge B is mounted in the apparatus main assembly A.

As shown in FIG. 5, the apparatus main assembly A is provided with a driving side-side plate 15 and the non-driving side-side plate 16 for supporting the cartridge B. As shown in FIG. 8, the driving side-side plate 15 is provided with a driving side-first supporting portion 15*a*, a driving side-second supporting portion 15*b* and a rotation supporting portion 15*c* for the cartridge B. As shown in FIG. 9, the non-driving side-side plate 16 is provided with a non-driving side-first supporting portion 16*a*, a non-driving side-second supporting portion 16*b* and a rotation supporting portion 16*c* for the cartridge B.

On the other hand, as driving side portions-to-be-supported of the cartridge B, a portion-to-be-supported 73*b* and a portion-to-be-supported 73*d* of a drum bearing 73, and a driving side boss 71*a* are provided as shown in FIG. 8. The portion-to-be-supported 73*b* is supported by the driving side-first supporting portion 15*a*, the portion-to-be-supported 73*d* is supported by the driving side-second supporting portion 15*b*, and the driving side boss 71*a* is supported by the rotation supporting portion 15*c*. Further, as non-driving side portions-to-be-supported, as shown in FIG. 9, a non-driving side projection 71*f* and a non-driving side boss 71*g* are provided. The non-driving side projection 71*f* is supported by the non-driving side-first supporting portion 16*a* and the non-driving side-second supporting portion 16*b*, and the non-driving side boss 71*g* is supported by the rotation supporting portion 16*c*. By the above-described structure, the cartridge B is positioned inside the apparatus main assembly A.

(General Structure of Cartridge)

Figure 4:
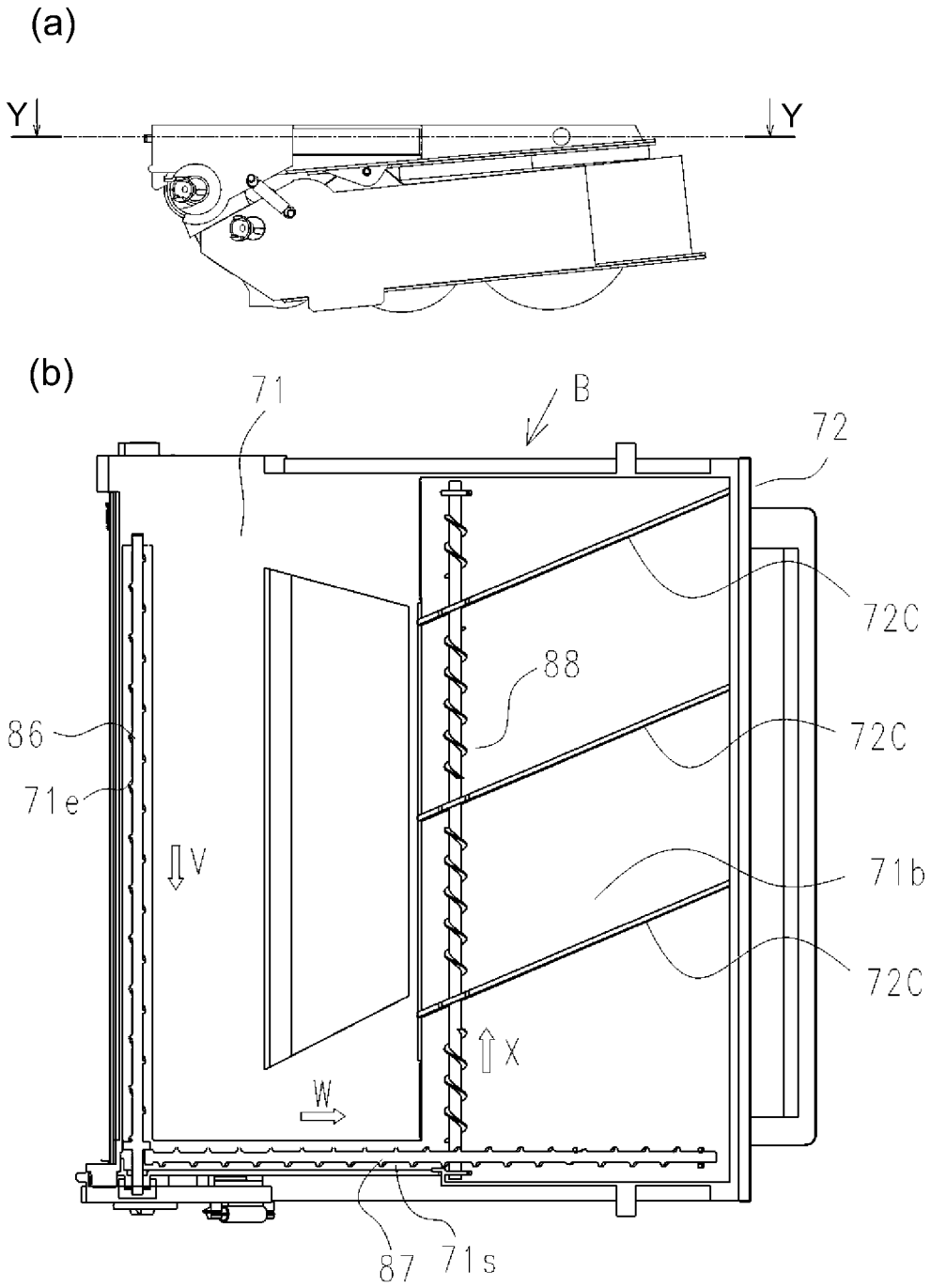
In FIG. 4, (a) is a side view of the process cartridge in which the accommodating container in the First Embodiment is mounted, and (b) is a sectional view showing an inside of a cleaning frame.
Figure 10:
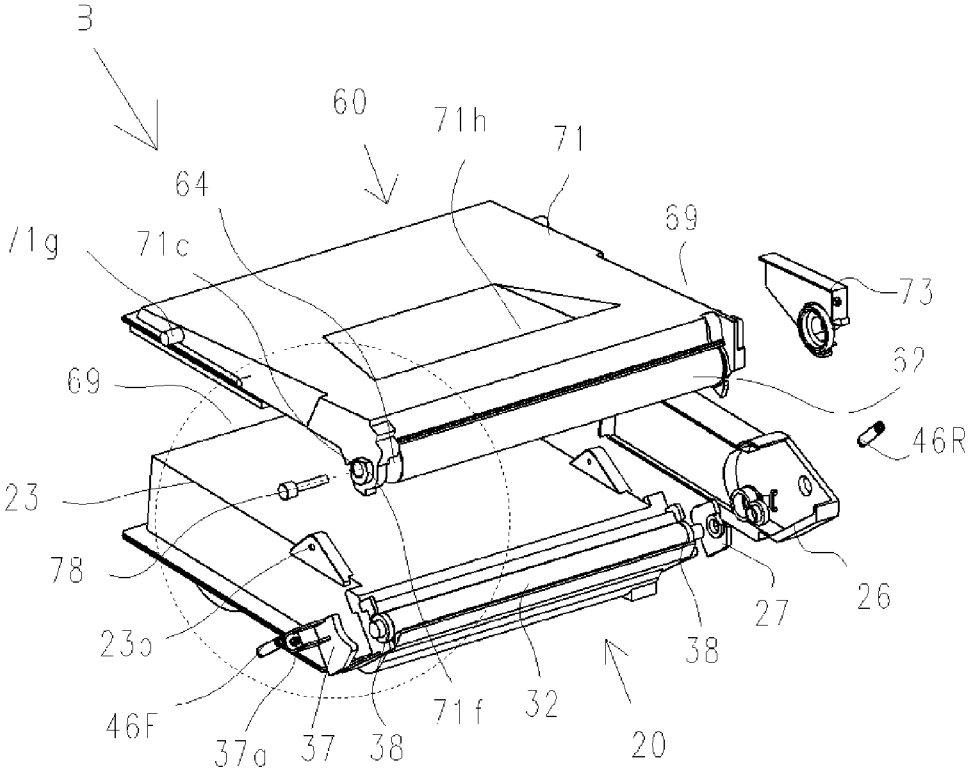
FIG. 10 is a general perspective view of the process cartridge in which the accommodating container in the First Embodiment is mounted as seen from a non-driving side.
Figure 11:
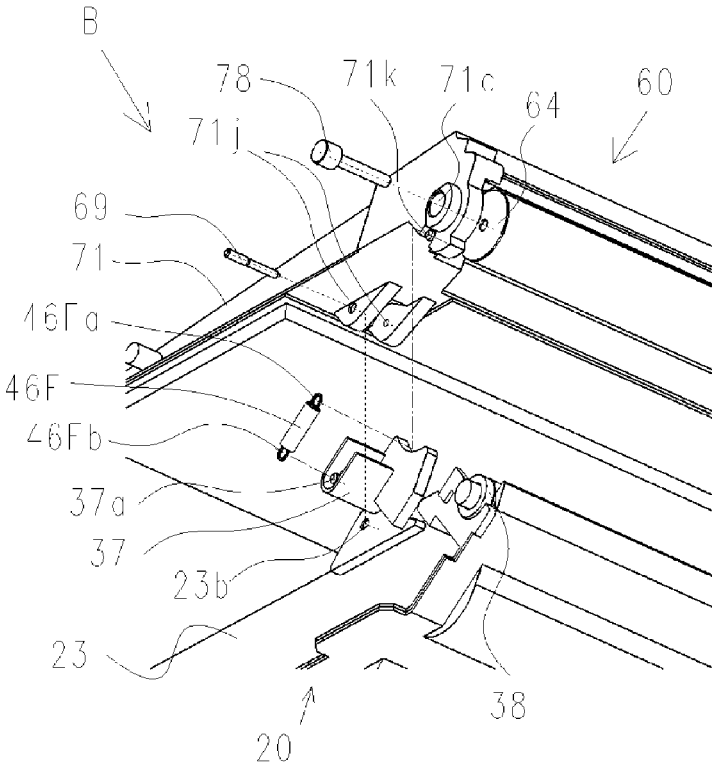
FIG. 11 is a partial perspective view of the process cartridge in which the accommodating container in the First Embodiment is mounted as seen from the non-driving side.

Next, a general structure of the cartridge B will be described with reference to FIGS. 3, 4 and 10-13. FIG. 3 is a sectional view of the cartridge B. In FIG. 4, (a) is a side view of the cartridge B, and (b) is a sectional view showing an inside of the cleaning frame 71. FIG. 10 is a general perspective view of the cartridge B as seen from the non-driving side. FIG. 11 is a general perspective view of the cartridge B as seen from the non-driving side. FIG. 2 is a general perspective view of the cartridge B as seen from the driving side. FIG. 13 is a partial perspective view of the cartridge B as seen from the driving side.

In FIG. 4, (a) is the side view of the cartridge B as seen from the driving side, and (b) is the sectional view showing the inside of the cleaning frame 71 as seen in an arrow Y direction in (a) of FIG. 4. FIG. 11 is an enlarged view showing an inside of a dotted circle of FIG. 10 (but an angle thereof is changed). FIG. 13 is an enlarged view showing an inside of a dotted circle of FIG. 12 (but an angle thereof is changed). In this embodiment, screws used when respective parts (components) are connected will be omitted from illustration.

The cartridge B is formed by the cleaning unit 60 and the developing unit 20 as shown in FIG. 3. The cleaning unit 60 includes the drum 62, the charging roller 66 and the cleaning member 77, and these members are supported by the cleaning frame 71. Further, to the cleaning frame 71, a cleaning cover 72 is fixed by welding or the like. Further, each of the charging roller 66 and the cleaning member 77 is disposed in contact with the outer peripheral surface of the drum 62.

In FIG. 3, the cleaning member 77 is formed by a rubber blade 77*a* which is a blade-shaped elastic member and a supporting member 77*b* for supporting the rubber blade 77*a*. The rubber blade 77*a* contacts the drum 62 counterdirectionally to a rotational direction of the drum 62. That is, the rubber blade 77*a* contacts the drum 62 so that a free end portion thereof faces toward an upstream side with respect to the rotational direction of the drum 62.

A residual toner (waste toner) removed from the surface of the drum by the cleaning member 77 is sequentially fed in the following manner. That is, as shown in (b) of FIG. 4, the residual toner is fed in directions of arrows V, W and X in a listed order by a first screw 86, a second screw (first feeding member) 87 and a third downstream (second feeding member) 88, respectively, as a residual toner feeding member. The residual toner is fed in the order of a cleaning chamber 71*e* and a residual toner feeding path 71*s* as shown in (b) of FIG. 4, and then is stored in a residual toner chamber 71*b* ((b) of FIG. 4), as an accommodating member (accommodating portion) for accommodating the developer (residual toner), formed by the cleaning frame 71 and the cleaning cover 72.

The first screw 86 is rotated by transmitting a driving force, received from the apparatus main assembly A by the cartridge B, through a gear (not shown) or the like. The second screw 87 is rotated by receiving the driving force from the first screw 86. The third screw 88 is rotated by receiving the driving force from the second screw 87. The first screw 86 is disposed in the neighborhood of the drum 62. The second screw 87 is disposed at a longitudinal end portion of the cleaning frame 71. The third screw 88 is disposed in the residual toner chamber 71*b*.

A rotational axis of the first screw 86 and a rotational axis of the third screw 88 are parallel to a rotational axis of the drum 62. A rotational axis of the second screw 87 is substantially perpendicular to the rotational axis of the photosensitive drum 62. An arrangement of the screws as a residual toner feeding means will be described later in detail.

In FIG. 3, a receptor sheet 65 for preventing the residual toner from leaking out of the cleaning frame 71 is provided at an end portion of the cleaning frame 71 so as to contact the drum 62. The drum 62 is rotationally driven in the arrow R direction in FIG. 3 depending on an image forming operation by receiving the driving force from a main assembly driving motor (not shown) which is a driving source.

The charging roller 66 is rotatably mounted to the cleaning unit 60 via charging roller bearings (not shown) at end portions thereof with respect to a longitudinal direction of the cleaning frame 71 (substantially parallel to a rotational axis direction of the drum 62). The charging roller 66 is press-contacted to the drum 62 by pressing the charging roller bearings toward the drum 62 by urging members (not shown). The charging roller 66 is rotated by rotation of the drum 62.

In FIG. 3, the developing unit 20 includes the developing roller 32 and the developing blade 42. The developing roller 32 and the developing blade 42 are supported by a developing container as the accommodating member for accommodating the developer. To the developing container 23, a bottom member 22 is fixed by welding or the like, whereby the toner supplying chamber 28 and the toner chamber 29 are formed. The toner supplying chamber 28 and the toner chamber 29 communicate with each other through a toner supply opening 30.

The developing roller 32 is a hollow member, and inside thereof, a magnet roller 34 is provided. The developing blade 42 regulates a toner layer (thickness) on the developing roller 32. As shown in FIG. 10, a gap-keeping member 38 is mounted to the developing roller 32 at each of end portions of the developing roller 32. By contact of the gap-keeping members 38 with the drum 62, the developing roller 32 is held so as to have a predetermined gap with the drum 62.

Further, as shown in FIG. 3, a leaking-out preventing sheet 33 is provided at an edge portion of the bottom member 22 so as to contact the developing roller 32. The leaking-out preventing sheet 33 prevents the toner from leaking out of the developing unit 20.

In the toner chamber 29, a first stirring member 43, a second stirring member 44 and a third stirring member 50 as rotatable members are provided. Each of the first stirring member 43, the second stirring member 44 and the third stirring member 50 rotates in the clockwise direction, and not only stirs the toner accommodated in the toner chamber 29 but also feeds the toner to the toner supplying chamber 28.

Figure 12:
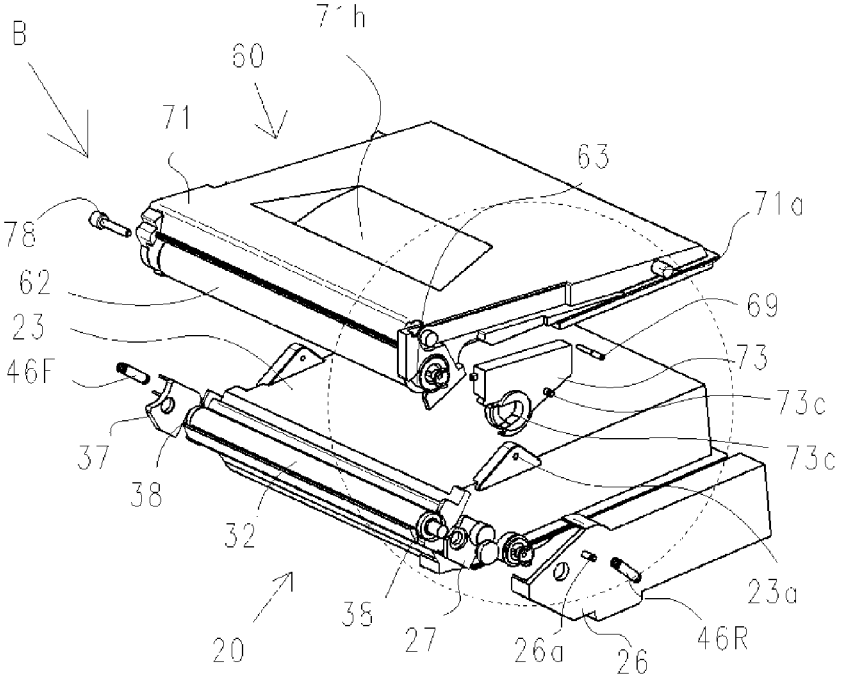
FIG. 12 is a general perspective view of the process cartridge in which the accommodating container in the First Embodiment is mounted as seen from the non-driving side.
Figure 13:
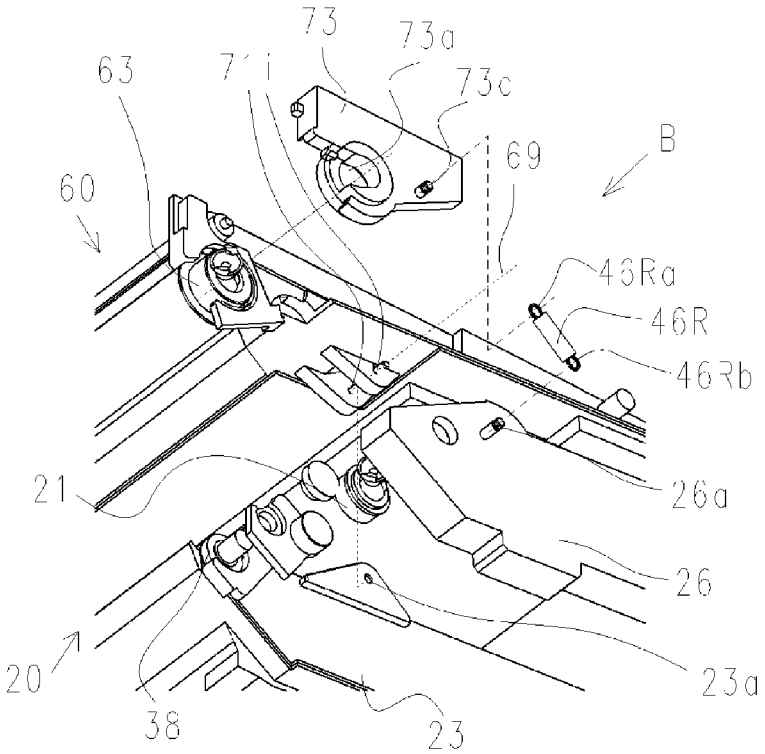
FIG. 13 is a partial perspective view of the process cartridge in which the accommodating container in the First Embodiment is mounted as seen from a driving side.

The cleaning unit 60 includes, as shown in FIG. 12, the drum bearing 73 and a drum shaft 78. As shown in FIG. 13, on the driving side of the drum 62, a driving side drum flange 63 provided on the driving side is rotatably supported by a hole 73*a* of the drum bearing 73. In the non-driving side, as shown in FIG. 11, the drum shaft 78 press-fitted in a hole 71*c* provided in the cleaning frame 71 rotatably supports a hole (not shown) of a non-driving side drum flange 64.

On the other hand, as shown in FIGS. 10 and 12, in the developing unit 20, by bearing members 27 and 37 provided at end portions of the developing roller 32, the developing roller 32 is rotatably supported.

As shown in FIGS. 11 and 13, connection between the cleaning unit 60 and the developing unit 20 are made by rotatably connecting the cleaning unit 60 and the developing unit 20 by connecting pins 69 relative to each other. Specifically, in the driving side of the developing unit 20, as shown in FIG. 13, a developing-first supporting hole 23*a* is provided as a part of the developing container 23. In the non-driving side, as shown in FIG. 11, a developing-second supporting hole 23*b* is provided as a part of the developing container 23.

Further, in the driving side of the cleaning unit 60, as shown in FIG. 13, first hanging holes 71*i* are provided as a part of the cleaning frame 71. In the non-driving side, as shown in FIG. 11, second hanging holes 71*j* are provided as a part of the cleaning frame 71. In the driving side, as shown in FIG. 13, the connecting pin 69 press-fitted and fixed in the first hanging holes 71*i* and the first supporting hole 23*a* engage with each other. In the non-driving side, as shown in FIG. 11, the connecting pin 69 press-fitted and fixed in the second hanging holes 71*j* and the second supporting hole 23*b* engage with each other. By the above-described constitution, the developing unit 20 is rotatably connected with the cleaning unit 60.

Further, as shown in FIG. 13, a first hole 46Ra of a driving side-urging member 46R is hooked on a boss 73*c* of the drum bearing member 73, and a second hole 46Rb of the driving side-urging member 46R is hooked on a boss 26*a* of the driving side-developing side member 26. Further, as shown in FIG. 11, a first hole 46Fa of a non-driving side-urging member 46F is hooked on a boss 71*k* of the cleaning frame 71, and a second hole 46Fb of the non-driving side-urging member 46F is hooked on a boss 37*a* of the bearing member 37.

As described above, in this embodiment, each of the driving side-urging member 46R and the non-driving side-urging member 46F is formed with a tension spring, and the developing unit 20 is urged toward the cleaning unit 60 by an urging force of these springs, so that the developing roller 32 is pressed toward the drum 62 with reliability.

(Structure of Residual Toner Chamber)

Figure 1:
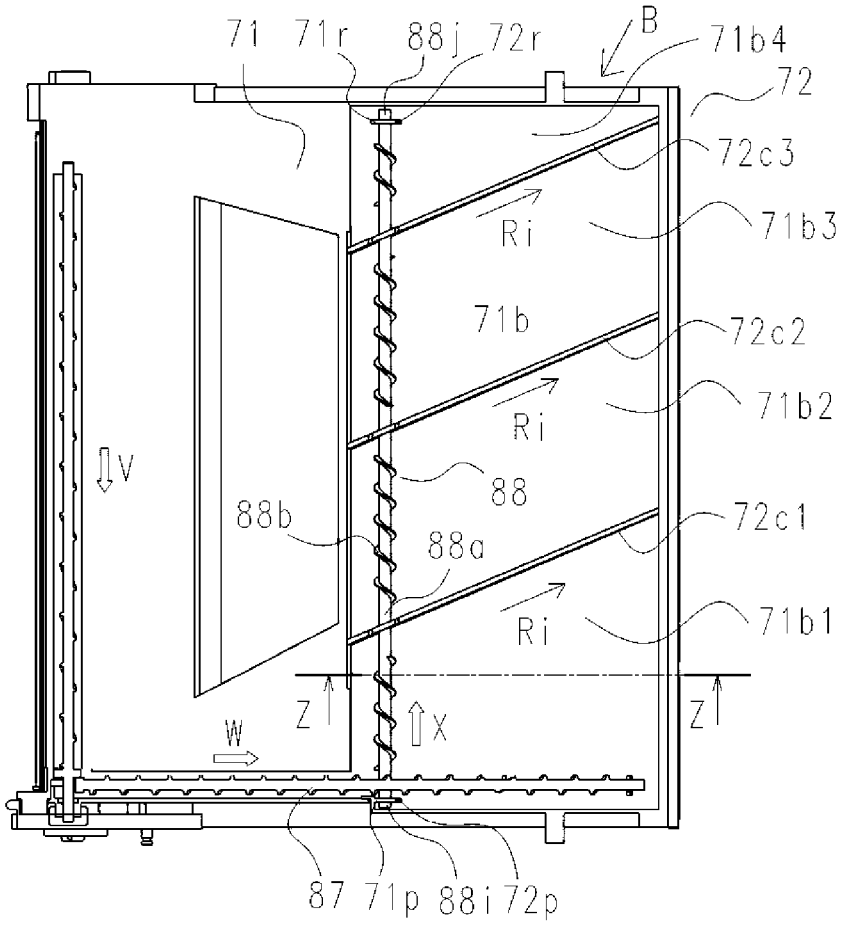
In FIG. 1, (a) and (b) are sectional views each showing a relationship between a third wall and a partition wall in a residual toner chamber as an accommodating container according to a First Embodiment of the present invention.
Figure 1:
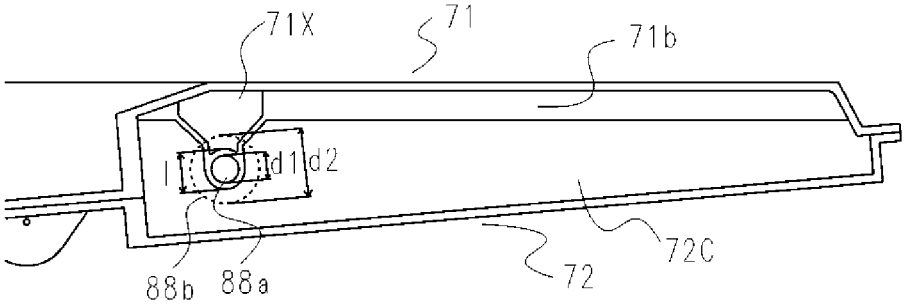

A structure of the residual toner chamber 71*b* as the accommodating container for accommodating the developer will be specifically described with reference to (a) and (b) of FIG. 1. In FIG. 1, (a) is a sectional view of the residual toner chamber 71*b* taken along Y-Y line shown in (a) of FIG. 4, and (b) is a sectional view of the residual toner chamber 71*b* taken along Z-Z line shown in (a) of FIG. 1. As shown in (a) of FIG. 1, in the residual toner chamber 72*b* the third screw 88 as the feeding member is rotatably provided, and 3 partition walls 72*c* (72*c*1-72*c*3) which are wall members are provided. In this embodiment, the inside of the residual toner chamber 71*b* are partitioned into 4 rooms by the 3 partition walls 72*c* (72*c*1-72*c*3).

In (a) of FIG. 1, the third screw 88 is constituted by a screw shaft portion 88*a*, a helical screw portion 88*b*, portions-to-be-supported 88*i* and 88*j* and a driven portion (not shown), and the screw portion 88*b* is a left-handed (counterclockwise) helical screw. In (a) and (b) of FIG. 1, the portions-to-be-supported 88*i* and 88*j* provided at longitudinal end portions of the third screw 88 are supported by being abutted against two supporting ribs 71*p* and 72*p* and two supporting ribs 71*r* and 72*r*, respectively, formed by the cleaning frame 71 and the cleaning cover 72.

The third screw 88 is provided below the second screw 87 with respect to the gravitational direction, and a driving force is transmitted from drive transmitting portion (not shown) of the second screw 87 to the third screw 88. Further, the partition walls 72*c* (821-72*c*3) are disposed inside the residual toner chamber 71*b* so as to cross the third screw 88, and are disposed at a plurality of positions along a rotational axis direction (arrow X direction) while being inclined in an obliquely rightward direction (hereinafter referred to as an Ri direction). The third screw 88 includes only the screw shaft 88*a* in each of sections (regions) where the third screw crosses the partition walls 72*c* (72*c*1-72*c*3) and no screw portion 88*b* is provided.

As shown in (b) of FIG. 1, in combination with the partition walls 72*c*, an upper partition wall 71*x* provided on the cleaning frame 71 is disposed above the partition wall 7, so that the residual toner chamber 72*b* is partitioned. Further, in (b) of FIG. 1, a relationship among a groove diameter l provided by the partition wall 72*c* and the upper partition wall 72*x*, a diameter d1 of the screw shaft portion 88*a* and a diameter d2 of the screw portion 88*b* is: d2>l>d1.

Thus, the toner fed in the arrow W direction by the second screw 87 is delivered to the third screw 88 at a crossing portion between the second screw 87 and the third screw 88 as seen from above. The toner delivered to the third screw 88 is fed in the arrow X direction and abuts against the first partition wall 72*c*.

At a crossing portion between the third screw 88 and the partition wall 72*c*, the screw portion 88*b* is cut away, and the crossing portion is a region consisting only of the screw shaft 88*a*, and therefore the toner feeding force in the arrow X direction which is the feeding direction lowers. The toner abutting against the first partition wall 72*c*1 moves along the first partition wall 72*c*1 and is fed in the Ri direction. The toner fed in the Ri direction is gradually accumulated in a first accommodating chamber 71*b*1 of the residual toner chamber 71*b*.

When the first accommodating chamber 71*b*1 is filled with the toner, the toner fed by the third screw 88 passes through a gap between the groove diameter l, provided by the first partition wall 72*c*1 and the upper downstream 71*x*, and the diameter d1 of the screw shaft portion 88*a*, and is fed to a second accommodating chamber 71*b*2. Thereafter, a relationship between the first accommodating chamber 71*b*1 and the second accommodating chamber 71*b*2 is similarly reproduced also between the second accommodating chamber 71*b*2 and a third accommodating chamber 71*b*3, and then the toner is finally accumulated in a fourth accommodating chamber 71*b*4.

As described above, the toner fed by the third screw 88 is successively filled in the residual toner chamber 71*b* from an upstream space partitioned by the partition walls 72*c* (72*c*1-72*c*3). Accordingly, in a side downstream of the third screw 88, the toner can be stably accommodated without exerting an excessive load, due to toner packing, on the third screw 88 which feeds the toner. A size of the residual toner chamber 71*b* is optimized depending on a residual toner amount estimated in a product.

The above-described relationship between the groove diameter l and the diameter d2 of the screw portion 88*b* may also be: l>d2>d1 at a crossing portion between the groove diameter l and the third screw 88.

In this embodiment, the partition wall 72*c* extending so as to incline in one side (rightward direction) toward a downstream side with respect to the feeding direction of the third screw 88 was provided, but may also be provided in the other side (leftward direction) with respect to the feeding direction of the third screw 88. Further, in this embodiment, the 3 partition walls 72*c* were provided to partition the residual toner chamber 71*b* into 4 rooms, but the number of the partition walls may also be changed to 4 or more, two, or one, so that the residual toner chamber 71*b* may be partitioned into 5 or more rooms, three rooms, or two room.

<Second Embodiment>

The Second Embodiment of the present invention will be described with reference to (a) and (b) of FIG. 14. In the First Embodiment, the relationship such that the partition wall 72*c* overlaps with the screw shaft portion 88*a* of the third screw 88 was established, but in this embodiment, a relationship such that the partition wall overlaps with the screw portion 88*b* of the third screw 88 is established. In this embodiment, only a portion different from that in the First Embodiment will be described by changing a reference numeral or symbol thereof, and materials and shapes of respective portions are similar to those in First Embodiment unless otherwise specified.

Figure 14:
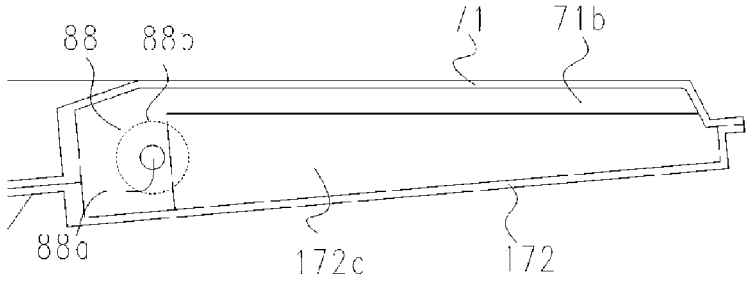
In FIG. 14, (a) and (b) are sectional views each showing a relationship between a third screw and a partition wall in an accommodating container according to a Second Embodiment.
Figure 14:
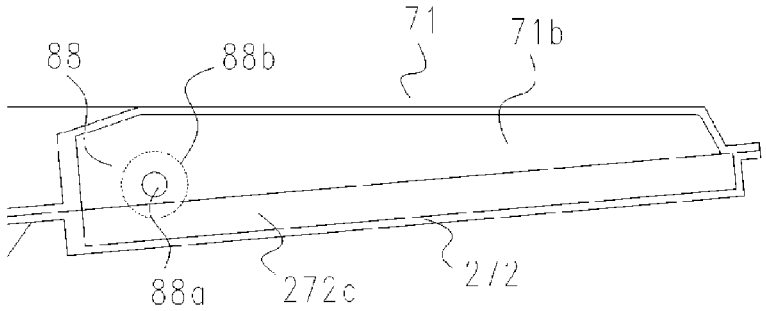

In FIG. 14, (a) and (b) are sectional views each showing the residual toner chamber 71*b* cut at the same position as that in (b) of FIG. 1. As shown in (a) of FIG. 14, a partition wall 172*c* is provided in a right side of the third screw 88. Further, the partition wall 172*c* has an overlapping relationship with the screw portion 88*b* of the third screw 88 with respect to the arrow X direction.

The toner fed by the third screw 88 abuts against an overlapping portion between the partition wall 172*c* and the screw portion 88*b* with respect to the arrow X direction. The abutted toner is fed along the partition wall 172*c* to a place spaced in the residual toner chamber 71*b* from the third screw 88. Thereafter, as described in the First Embodiment, the residual toner chamber 71*b* is successively filled with the toner from an upstream space partitioned by the partition walls 172*c*. Accordingly, the toner can be stably accommodated without exerting an excessive load, due to toner packing in a side downstream of the third screw 88, on the third screw 88 which feeds the toner.

In (a) of FIG. 14, the partition wall 172*c* was disposed in an upper side of the third screw 88, but as shown in (b) of FIG. 14, a similar effect is achieved also in the case where a partition wall 272*c* is provided in a lower side of the third screw 88.

<Third Embodiment>

The Third Embodiment of the present invention will be described with reference to (a) and (b) of FIG. 15. In the above-described embodiments, the constitution in which the first and second wall members extended in the right (same) direction with respect to the feeding direction (rotational axis direction) of the third screw 88 was employed, but in this embodiment, a constitution in which the first and second wall members extend in right and left (different) directions is employed. Of the first and second wall members, the wall member close to an inner wall of the accommodating container has a constitution in which there is a gap between the wall member and the inner wall in the accommodating container at a downstream end portion.

In this embodiment, only a portion different from those in the above-described embodiments will be described by changing a reference numeral or symbol thereof, and materials and shapes of respective portions are similar to those in the above-described embodiments unless otherwise specified.

Figure 15:
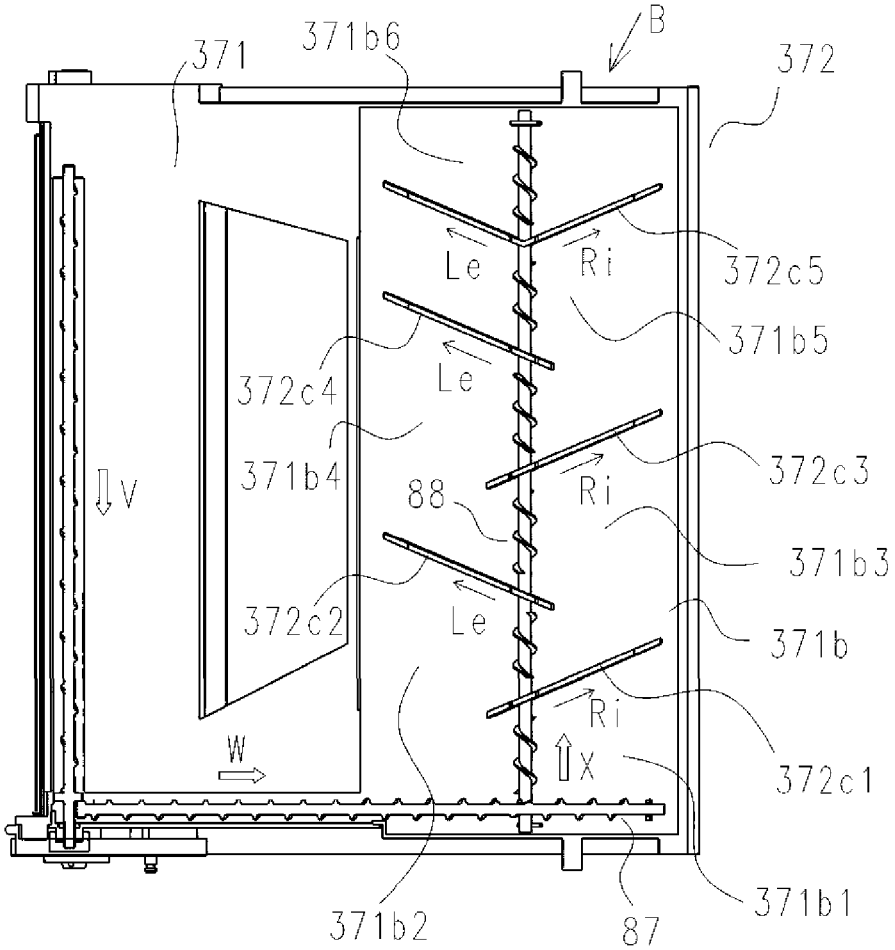
In FIG. 15, (a) and (b) are schematic views each showing a relationship between a third screw and a wall in an accommodating container according to a Third Embodiment.
Figure 15:
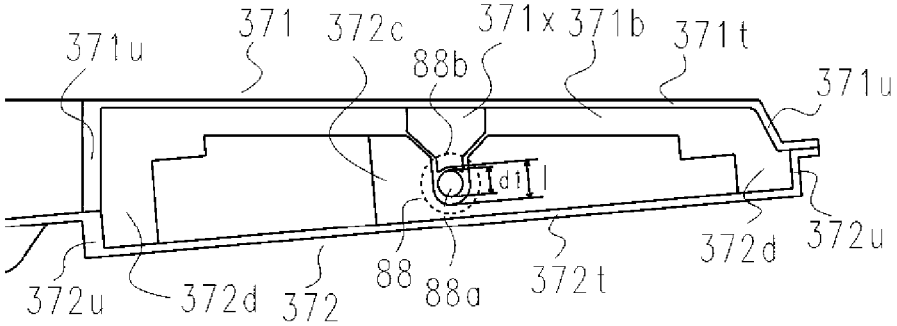

In FIG. 15, (a) and (b) are sectional views each showing a residual toner chamber 371*b* cut at the same position as that in (b) of FIG. 1. In (a) of FIG. 15, a plurality of partition walls 372*c* will be described as partition walls 372*c*1-372*c*5.

As shown in (a) and (b) of FIG. 15, the plurality of partition walls 372*c* for the residual toner chamber 371*b* are disposed on both (right and left) sides of the third screw 88 and are inclined toward the downstream side with respect to the arrow X direction with an increasing distance from the third screw 88. Further, the partition walls 372*c* are disposed alternately in the right and left sides with respect to the arrow X direction, and in the downstream side of the third screw 88, the partition wall 372*c* is disposed so as to extend from the same position of the screw shaft portion 88*a* toward the left and right sides while being inclined. In this embodiment, the residual toner chamber 371*b* is partitioned into 6 rooms by 5 partition walls 372*c*.

Further, as shown in (b) of FIG. 15, the residual toner chamber 371*b* is constituted by an upper cleaning frame surface 371*t* and a side cleaning frame surface 371*u* of the cleaning frame 371, and a lower cleaning cover surface 372*t* and a side cleaning cover surface 372*u* of the cleaning cover 372. Further, the partition wall 372*c* is provided with a packing preventing flow path 372*d* between the side cleaning frame surface 371*u* and the side cleaning cover surface 372*u*.

The toner fed in the arrow W direction by second screw 87 is delivered to the third screw 88 at a crossing portion between the second screw 87 and the third screw 88. The toner delivered to the third screw 88 is fed in the arrow X direction and abuts against the first partition wall 372*c*1.

The toner abutting against the first partition wall 372*c*1 moves along the first partition wall 372*c*1 and is fed in the Ri direction. The toner fed in the Ri direction is gradually accumulated in a first accommodating chamber 371*b*1 of the residual toner chamber 371*b*.

When the first accommodating chamber 371*b*1 is filled with the toner, the toner fed by the third screw 88 passes through a gap between the groove diameter l, provided by the first partition wall 372*c*1 and the upper partition wall 371*x*, and the diameter d1 of the screw shaft portion 88*a*, and is fed to a second accommodating chamber 371*b*2. The toner fed to the second accommodating container 371*b*2 is fed in the arrow X direction by the third screw 88 and then abuts against the second partition wall 372*c*2 inclined in an obliquely leftward direction (Le direction) with respect to the arrow X direction.

The toner abutted against the second partition wall 372*c* moves along the second partition wall 372*c*2 and is fed in the Le direction. The toner fed in the Le direction is gradually accumulated in the second accommodating container 371*b*2. Also in the third accommodating container 371*b*3 and later accommodating containers, the above-described relationship between the first accommodating container 371*b*1 and the second accommodating container 371*b*2 is reproduced. Further, when the toner abuts against the fifth partition wall 372*c*5 provided in the downstream side of the third screw 88, the toner is fed along the fifth partition wall 372*c*5 toward the left and right sides of the fifth accommodating container 371*b*5.

As described above, the toner fed by the third screw 88 is successively filled in the residual toner chamber 371*b* from an upstream space partitioned by the partition walls 372*c*. Further, the third screw 88 is provided with the partition walls 372*c* in the left and right (both) sides, compared with the First Embodiment, the toner can be accumulated in every corner. Accordingly, even when the process cartridge is increased in capacity and lifetime, it becomes possible to accommodate the toner efficiently and stably.

In this embodiment, in the residual toner chamber 371*b*, the partition walls 372*c* were disposed alternately in the right and left (both) sides of the third screw 88 with respect to the toner feeding direction of the third screw 88, but the partition walls 372*c* may also be disposed in the left and right (both) sides at the same position with respect to the feeding direction of the third screw 88.

In the case where a toner feeding amount per unit time is large or the toner excessively taken up moisture, the toner cannot be completely sent to the second accommodating container 371*b*2 through the gap between the groove diameter l provided by the first partition wall 372*c*1 and the upper partition wall 371*x* and the diameter d1 of the screw shaft portion 88*a* in some instances. In this case, the toner is fed to the first accommodating container 371*b*1. However, in this embodiment, in the case where the toner is excessively fed to the first accommodating container 371*b*1, the toner is caused to flow from the packing preventing flow path 372*d* into the second accommodating container 371*b*2.

Thus, in this embodiment, even in the case where the toner is excessively fed into each of the accommodating containers, the packing preventing flow path 372*d* is provided among the partition wall 372*c*, the side cleaning frame surface 371*u* and the side cleaning cover surface 372*u*, whereby the toner is prevented from being packed. For that reason, the toner can be accommodated stably without exerting an excessive load on the third screw which feeds the toner.

(Modified Embodiments)

Preferred embodiments of the present invention were described above, but the present invention is not limited thereto. Various modifications and changes of constitutions of the present invention are possible within the scope of the present invention. Incidentally, with respect to functions, materials, shapes and relative arrangement of constituent elements described in the above embodiments, the scope of the present invention is not intended to be limited only to these parameters.

(Modified Embodiment 1)

The present invention having the constitutes relating to the accommodating containers described in the above-described embodiments is not limited to those for feeding the residual toner. For example, the present invention may also be used for feeding the developer in the developing device including a developer carrying member (developing roller) for carrying the developer to be supplied to the photosensitive drum as the image bearing member.

(Modified Embodiment 2)

In the above-described embodiments, the accommodating container for feeding the developer is provided in the process cartridge insertable into the apparatus main assembly of the image forming apparatus, but may also be provided in an apparatus main assembly of an image forming apparatus in which the process cartridge is not used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-202501 filed on Oct. 14, 2015, which is hereby incorporated by reference herein in its entirety.

What is claimed is:

1. An accommodating device for collecting developer from an image bearing member, comprising:

an accommodating container for accommodating the developer from the image bearing member;

a feeding member for feeding the developer in a developer feeding direction and provided in said accommodating container; and a wall member for partitioning inside of said accommodating container, said wall member provided in said accommodating container extending along a direction crossing the developer feeding direction and inclined toward a downstream side of said feeding member with respect to the developer feeding direction, wherein said wall member is contactable to the developer being fed in the developer feeding direction.

2. An accommodating container according to claim 1, wherein said feeding member includes a rotation shaft and a helical blade, provided around said rotation shaft, for feeding the developer in the developer feeding direction.

3. An accommodating container according to claim 2, wherein said feeding member includes a first region where said helical blade is provided around said rotation shaft and a second region where only said rotation shaft is provided, and wherein said wall member is provided along the direction crossing the developer feeding direction in the second region where only said rotation shaft of said feeding member is provided.

4. An accommodating container according to claim 2, wherein said wall member is provided along the direction crossing the developer feeding direction in a region where said helical blade is provided around said rotation shaft.

5. An accommodating container according to claim 2, wherein said wall member is provided with a gap through which said rotation shaft penetrates.

6. An accommodating container according to claim 5, wherein a plurality of wall members are disposed at a plurality of positions along the developer feeding direction.

7. An accommodating container according to claim 6, wherein the plurality of wall members include a first wall member extending toward a first direction, and a second wall member extending toward a second direction, and wherein the first direction is different from the second direction.

8. An accommodating container according to claim 1, wherein said wall member is provided substantially on one side of said feeding member with respect to the developer feeding direction.

9. An accommodating container according to claim 1, wherein said wall member is provided on both sides of said feeding member with respect to the developer feeding direction.

10. An accommodating container according to claim 9, wherein said wall member includes a plurality of wall members provided alternately on one side and on the other side of the both sides toward a downstream side of said feeding member.

11. An accommodating container according to claim 9, wherein said wall member includes a plurality of members each including an upstream end portion at a position where said member crosses the developer feeding direction of said feeding member.

12. An accommodating container according to claim 1, wherein said wall member is provided with a gap from an inner wall of said accommodating container at a downstream end portion thereof with respect to the developer feeding direction.

13. A cleaning device comprising:

a collecting member for collecting a developer from an image bearing member; and an accommodating device according to claim 1 for accommodating the developer collected by said collecting member at an accommodating portion where said accommodating container is provided.

14. A process cartridge insertable into a main assembly of an image forming apparatus, comprising:

an image bearing member; and an accommodating device according to claim 1.

15. An image forming apparatus comprising:

an image bearing member;

an accommodating device according to claim 1; and an exposure device for forming an electrostatic latent image on said image bearing member, wherein said image bearing member and said feeding device are provided in a process cartridge or in a main assembly of said image forming apparatus in which the process cartridge is not used.

16. A cartridge insertable into a main assembly of an image forming apparatus, comprising:

a chamber for accommodating a developer;

a feeding member provided in said chamber, said feeding member including a blade portion configured to rotate around a rotational axis and for feeding the developer in a developer feeding direction, the developer feeding direction including a rotational axis direction;

a first wall member for partitioning inside of said chamber, said first wall member provided in said chamber, extending along a direction crossing the rotational axis direction, and inclined toward a downstream side of said feeding member with respect the developer feeding direction; and a second wall member for partitioning inside of said chamber, said second wall member provided in said chamber, extending along the direction crossing the rotational axis direction, and inclined toward the downstream side of said feeding member with respect the developer feeding direction; and wherein said second wall member is located in a downstream side of said first wall member with respect to the developer feeding direction, and wherein when said feeding member is viewed from the rotational axis direction, at least a part of said blade portion overlaps with at least a part of said first wall member, and at least a part of said blade portion overlaps with at least a part of said second wall member.

17. A cartridge according to claim 16, wherein said first wall includes a first groove for accommodating said feeding member, and said second wall includes a second groove for accommodating said feeding member.

18. A cartridge according to claim 17, wherein the feeding member includes a first region where a toner feeding force in the developer feeding direction lowers and a second region where a toner feeding force in the developer feeding direction lowers, and wherein in the rotational axis direction, a position of said first groove overlaps with a position of the first region, and a position of said second groove overlaps with a position of the second region.

19. A cartridge according to claim 18, wherein said first wall is extended toward a first direction, and said second wall member is extended toward a second direction crossing the first direction.

20. An accommodating container according to claim 19, wherein said first wall member is provided with a gap from an inner wall of said chamber at a downstream end portion thereof with respect to the developer feeding direction, and said second wall member is provided with a gap from the inner wall of said chamber at a downstream end portion thereof with respect to the developer feeding direction.

* * * * *